US006611107B2

(12) United States Patent
Mikami et al.

(10) Patent No.: US 6,611,107 B2
(45) Date of Patent: Aug. 26, 2003

(54) IMAGE DISPLAY APPARATUS

(75) Inventors: Yoshiro Mikami, Hitachiota (JP); Takayuki Ouchi, Hitachi (JP); Hajime Akimoto, Ome (JP); Toshihiro Satou, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/083,548

(22) Filed: Feb. 27, 2002

(65) Prior Publication Data

US 2003/0111966 A1 Jun. 19, 2003

(30) Foreign Application Priority Data

Dec. 19, 2001 (JP) ..... 2001-385630

(51) Int. Cl.[7] ..... G09G 3/10

(52) U.S. Cl. ..... 315/169.1; 315/169.3; 345/98; 345/84; 327/91; 327/94; 257/59; 257/72

(58) Field of Search ..... 315/169.3, 169.1, 315/169.2; 345/77, 84, 90, 92, 98, 905; 257/59, 72, 350, 360; 327/91, 94

(56) References Cited

U.S. PATENT DOCUMENTS 5,952,854 A * 9/1999 Kubota et al. ..... 327/91
6,020,867 A * 2/2000 Shimada et al. ..... 345/87
6,239,788 B1 * 5/2001 Nohno et al. ..... 345/173
6,392,255 B1 * 5/2002 Shibata et al. ..... 257/59

FOREIGN PATENT DOCUMENTS

JP 10232649 A * 9/1998
JP 2001100655 A * 4/2001

OTHER PUBLICATIONS

T. Shimoda et al., "Current status and future of Light–Emitting Polymer Display Driven by Poly–Si TFT", 1999, SID99 Technical Digest, pp. 372–375.*

* cited by examiner

*Primary Examiner*—Haissa Philogene
(74) *Attorney, Agent, or Firm*—Antonelli, Terry, Stout & Kraus, LLP

(57) ABSTRACT

As each of sampling switch elements turns on in response to a scanning signal, a signal voltage from a signal wire is held on and written into a sampling capacitor. At this time, the signal voltage is held on the sampling capacitor on the basis of a common electrode. As the scanning signal transitions from high level to low level, each of the sampling switch elements turns off and changes into a floating state in which the sampling capacitor is electrically insulated from the signal wire and a driving TFT. As the scanning signal changes from high level to low level, each of the driving switches becomes conductive so that the signal voltage held on the sampling capacitor is applied as it is between the source and gate of the driving TFT as a bias voltage to make the driving TFT conductive, causing an organic LED to emit light.

15 Claims, 13 Drawing Sheets

IMAGE DISPLAY APPARATUS

BACKGROUND OF THE INVENTION

The present invention relates to an image display apparatus, and more particularly, to a light emission type image display apparatus suitable for displaying an image using current driven display elements, specifically, organic light emitting diodes (LED).

An organic EL-based flat image display apparatus has been known as one type of image display apparatus. This type of image display apparatus employs a driving method using low temperature polysilicon TFTs (thin film transistors) in order to implement a high luminance active matrix display, for example, as described in SID 99 technical digest, pages 372–375. For employing this driving method, the image display apparatus takes a pixel structure in which scanning wires, signal wires, EL power supply wires and capacitance reference voltage wires are intersected with one another, and has a signal voltage holding circuit formed of an n-type scanning TFT and a storage capacitor for driving each EL. A signal voltage held in the holding circuit is applied to a gate of a p-channel driving TFT arranged in a pixel to control the conductance of a main circuit of the driving TFT, i.e., the resistance value between its source and drain. In this structure, the main circuit of the driving TFT and an organic EL element are connected in series with each other from an EL power supply wire, and also connected to an LED common wire.

For driving a pixel configured as described above, a pixel selection pulse is applied from an associated scanning wire to write a signal voltage into the storage capacitor through a scanning TFT for holding the signal voltage. The held signal voltage is applied to the driving TFT as a gate voltage to control a drain current in accordance with the conductance of the driving TFT determined from a source voltage connected to a power supply wire, and a drain voltage. As a result, a driving current of the EL element is controlled to control a display luminance. In this event, in the pixel, a source electrode of the driving transistor is connected to the power supply wire, which causes a voltage drop. The driving transistor has a drain electrode connected to one end of the organic LED element, the other end of which is connected to a common electrode shared by all pixels. The driving transistor is applied with the signal voltage at its gate, such that the operating point of the transistor is controlled by a differential voltage between the signal voltage and source voltage to realize a gradation display.

However, when the foregoing configuration is applied to implement a large-sized panel, voltages for driving pixels in a central region of the panel are lower than voltages for driving pixels in a peripheral region of the panel. Specifically, the organic LED element is current driven, so that if a current is supplied to a pixel in a central region of the panel from a power supply through a LED common wire, a voltage drop is caused by the wire resistance, thereby reducing the voltage for driving the pixel in the central region of the panel. Since this voltage drop is affected by the length of the wire and a display state of pixels connected to the wire, the voltage drop also varies depending on displayed contents.

Further, the operating point of a driving transistor for a pixel largely varies in response to a varying source voltage of the driving transistor connected to the LED common wire, so that a current for driving LEDs largely varies. The variations in current cause variations in the luminance of display, i.e., uneven display and non-uniform luminance, as well as cause a defective display in the form of non-uniform color balance in the screen when a color display is concerned.

To solve these problems, JP-A-2001-100655, for example, has proposed an improvement on a voltage drop caused by a wire by reducing a wiring resistance. In a system described in JP-A-2001-100655, a conductive light shielding film having an opening for each pixel is disposed over the entire surface of a panel and connected to a common power supply wire to reduce the wire resistance and accordingly improve the uniformity of display.

However, in the system described in JP-A-2001-100655, since a source electrode, acting as a reference voltage for a transistor for driving an organic LED in a pixel is connected to an LED common electrode shared by the panel, some voltage drop is produced between the source electrode and common electrode. For this reason, even if the same signal voltage is applied, the gate-source voltage, which determines the operating point of the transistor, varies in response to variations in the source voltage, thereby encountering difficulties in removing the non-uniformity of display.

Also, the foregoing system has such a nature that variations in a threshold value, i.e., the on-resistance of a driving TFT for driving an EL cause a change in an EL driving current even if the same signal voltage is applied for controlling the current, so that TFTs which exhibit few variations and uniform characteristics are required for implementing the system. However, transistors for use in realizing such a driving circuit are obliged to be low temperature polysilicon TFTs which are manufactured using a laser anneal process and are high in mobility and applicable to a large-sized substrate. However, the low temperature polysilicon TFTs are known to suffer quite a few variations in element characteristics. Thus, due to the variations in the characteristics of TFTs used in an organic EL driving circuit, the luminance varies pixel by pixel, even if the same signal voltage is applied, so that the low temperature polysilicon TFT is not suitable for displaying a highly accurate gradation image.

As a driving method for solving the foregoing problems, JP-A-10-232649, for example, proposes a driving method for providing a gradation display which divides a one-frame time into eight sub-frames which are different in display time, and changes a light emitting time within the one-frame time to control an average luminance. This driving method drives a pixel to display digital binary values representing a lit and an unlit state to eliminate the need for using the operating point near a threshold value at which variations in the characteristics of TFTs are notably reflected to a display, thereby making it possible to reduce variations in luminance.

Any of the foregoing prior art techniques does not sufficiently consider the non-uniformity in luminance due to a voltage drop on a power supply wire of organic LEDs, and fails to solve a degraded image quality due to the voltage drop on the power supply wire, particularly in a large-sized panel.

In addition, the prior art techniques may reduce the conductance of the transistors to set a high LED power supply voltage for preventing a varying voltage on the LED common wire, thereby reducing variations in luminance. However, this leads to a lower power efficiency and increased power consumption of a resulting image display apparatus. Also, since a transistor presenting a low conductance has a longer gate length, the transistor has a larger size which is a disadvantage in regard to the trend of higher definition.

SUMMARY OF THE INVENTION

It is an object of the present invention to provide an image display apparatus which is capable of suppressing a degraded image quality even if a voltage drop is caused by a power supply wire.

To solve the foregoing problems, the present invention provides an image display apparatus which includes a plurality of scanning wires distributively arranged in an image display region for transmitting a scanning signal, a plurality of signal wires arranged to intersect with the plurality of scanning wires in the image display region for transmitting a signal voltage, a plurality of current driven electro-optical display elements each arranged in a pixel region surrounded by each of the scanning wires and each of the signal wires and connected to a common power supply, a plurality of driving elements each connected in series with each of the electro-optical display elements, connected to the common power supply, and applied with a bias voltage to drive each of the electro-optical display elements for display, and a plurality of memory control circuits each for holding the signal voltage in response to the scanning signal to control driving of each of the driving elements based on the held signal voltage, wherein each of the memory control circuit samples and holds the signal voltage while blocking a bias voltage from being applied to each of the driving elements, and subsequently applies each of the driving elements with the held signal voltage as the bias voltage.

For implementing the image display apparatus, the plurality of memory control circuits may be configured to have the following functions.

(1) Each memory control circuit samples and holds the signal voltage while blocking a connection with each of the driving elements, and subsequently releases the blocked state to apply each of the driving elements with the held signal voltage as the bias voltage.

(2) Each memory control circuit executes a sampling operation for sampling the signal voltage in response to the scanning signal and holding the sampled signal voltage, a floating operation, following the sampling operation, for holding the signal voltage in an electrically insulated state from each of the signal wires and driving elements, and a bias voltage applying operation, following the floating operation, for applying each of the driving elements with the held signal voltage as a bias voltage.

For implementing each of the image display apparatus, the following elements may be added.

(1) Each of the memory control circuits includes a main sampling switch element responsive to the scanning signal to conduct for sampling the signal voltage, a sampling capacitor for holding the signal voltage sampled by the main sampling switch element, an auxiliary sampling switch element responsive to the scanning signal to conduct for connecting one end of the sampling capacitor to a common electrode, a main driving switch element connected to the one end of the sampling capacitor and to one bias voltage applying electrode of the driving element, and conducting when the polarity of the scanning signal is inverted, and an auxiliary driving switch element connected to the other end of the sampling capacitor and to the other bias voltage applying electrode of the driving element, and conducting when the polarity of the scanning signal is inverted.

(2) Each of the driving elements includes a p-type thin film transistor, each of the main sampling switch elements and auxiliary sampling switch elements includes an n-type thin film transistor, and each of the main driving switch elements and auxiliary driving switch elements includes a p-type thin film transistor.

(3) A plurality of inverted scanning wires are each arranged in parallel with each of the scanning wires for transmitting an inverted scanning signal having a polarity opposite to that of the scanning signal. Each of the memory control circuits includes a main sampling switch element responsive to the scanning signal to conduct for sampling the signal voltage, a sampling capacitor for holding the signal voltage sampled by the main sampling switch element, an auxiliary sampling switch element responsive to the scanning signal to conduct for connecting one end of the sampling capacitor to a common electrode, a main driving switch element connected to the one end of the sampling capacitor and to one bias voltage applying electrode of the driving element, and responsive to the inverted scanning signal to conduct, and an auxiliary driving switch element connected to the other end of the sampling capacitor and to the other bias voltage applying electrode of the driving element, and responsive to the inverted scanning signal to conduct.

(4) Each of the driving elements includes an n-type thin film transistor, each of the main sampling switch elements and auxiliary sampling switch elements includes an n-type thin film transistor, and each of the main driving switch elements and auxiliary driving switch elements includes an n-type thin film transistor.

(5) A plurality of inverted scanning wires are each arranged in parallel with each of the scanning wires for transmitting an inverted scanning signal having a polarity opposite to that of the scanning signal. Each of the memory control circuits includes a main sampling switch element responsive to the scanning signal to conduct for sampling the signal voltage, a sampling capacitor for holding the signal voltage sampled by the main sampling switch element, an auxiliary sampling switch element responsive to the scanning signal to conduct for connecting one end of the sampling capacitor to a common electrode, and a main driving switch element connected to the one end of the sampling capacitor and to one bias voltage applying electrode of the driving element, and responsive to the inverted scanning signal to conduct. Each of the sampling capacitors has the other end connected to the other bias voltage applying electrode of each of the driving elements.

(6) Each of the driving elements includes an n-type thin film transistor, each of the main sampling switch elements and auxiliary sampling switch elements includes an n-type thin film transistor, and each of the main driving switch elements and auxiliary driving switch elements includes an n-type thin film transistor.

According to the foregoing configurations, for writing a signal voltage from the signal wire into a pixel in each pixel region, the signal voltage is sampled and held while a bias voltage is blocked from being applied to each driving element, and the held signal voltage is then applied to the driving element as a bias voltage, so that after a sampling operation for sampling the signal voltage, the signal voltage is held in a floating state, in which the sampling capacitor is electrically insulated from the signal wire and driving element, and the held signal voltage is subsequently applied to the driving element as a bias voltage. Thus, the held signal voltage can be applied as it is to the driving element as the bias voltage without being affected by a voltage drop, if any, on a power supply wire connected to the driving element, thereby making it possible to drive the driving element for providing a display at a specified display luminance, and accordingly to display an image of high quality. As a result, an image can be displayed in a high quality even when the image is displayed on a large-sized panel.

Also, since a good image can be displayed without increasing the power supply voltage or using low conductance transistors, a high definition image can be displayed with low power consumption.

The present invention also provides an image display apparatus which includes a plurality of scanning wires distributively arranged in an image display region for transmitting a scanning signal, a plurality of signal wires arranged to intersect with the plurality of scanning wires in the image display region for transmitting a signal voltage, a plurality of memory circuits each arranged in a pixel region surrounded by each of the scanning wires and each of the signal wires for holding the signal voltage in response to the scanning signal, a plurality of current driven electro-optical display elements each arranged in each of the pixel regions and connected to a common power supply, and a plurality of driving elements each connected in series with each of the electro-optical display elements, connected to the common power supply, and applied with a bias voltage to drive each of the electro-optical display elements for display. Each of the memory circuits includes a sampling switch element responsive to the scanning signal to conduct for sampling the signal voltage, and a sampling capacitor for holding a signal voltage sampled by the sampling switch element. Each of the sampling capacitors has one end connected to the common power supply through each of the driving elements or a power supply wire, and the other end connected to a gate electrode of each of the driving elements. In a sampling period in which the sampling switch element of each of the memory circuits holds the signal voltage, each of the driving elements is brought into a non-driving state by changing a voltage of the common power supply or maintaining a potential on a common electrode shared by the driving elements in the common power supply at a ground potential. Each of the driving elements is applied with a bias voltage after the sampling period has passed.

For implementing the foregoing image display apparatus, a plurality of power supply control elements may be provided for controlling electric power supplied from the common power supply to each of the driving elements. Each of the power supply control elements and memory circuits may be configured to have the following functions.

(1) Each of the memory circuits may include a sampling switch element responsive to the scanning signal to conduct for sampling the signal voltage, and a sampling capacitor for holding a signal voltage sampled by the sampling switch element, wherein each of the sampling capacitors has one end connected to the common power supply through each driving element or a power supply wire, and each of the sampling capacitors has the other end connected to a gate electrode of each driving element. In a sampling period in which the sampling switch element of each memory circuit holds the signal voltage, each of the power control element stops supplying the electric power to each of the driving elements, and supplies the electric power to each driving element after the sampling period has passed.

For implementing each of the foregoing image display apparatuses, the following elements may be added.

(1) Each of the sampling switch elements, driving elements and power control elements may include an n-type thin film transistor, and each of the power supply control elements may be responsive to a reference control signal to conduct when the reference control signal changes to a high level in a period out of the sampling period.

(2) Each of the sampling switch elements and driving elements may include an n-type thin film transistor, and each of the power supply control elements may include a p-type thin film transistor, and be responsive to the scanning signal to conduct when the scanning signal changes to a low level in a period out of the sampling period.

(3) Each of the sampling switch elements, driving elements and power supply control elements may include an p-type thin film transistor, and each of the power supply control elements may be responsive to a reference control signal to conduct when the reference control signal changes to a low level in a period out of the sampling period.

(4) The plurality of current driven electro-optical display elements may include organic LEDs, respectively.

According to the foregoing configurations, for writing a signal voltage from the signal wire into a pixel in each pixel region, in a sampling period in which a signal voltage is held in the sampling switch element, a voltage of a common power supply is changed or a potential on a common electrode shared by the driving elements of the common power supply is held substantially at a ground potential to bring one line or all of driving elements into a non-driving state. After the sampling period has passed, each of the driving elements is applied with a bias voltage. Alternatively, in the sampling period in which a signal voltage is held in the sampling switch element, the power supplied to each driving element is stopped, and after the sampling period has passed, each driving element is supplied with the power, so that a bias voltage to each driving element can be substantially the same bias voltage as a signal voltage applied to sampling capacitance for all the driving element considering ground voltage as the substantial reference. It is therefore possible to display an image of high quality on a large sized panel even if a power supply voltage varies, or a voltage drop for each pixel is caused by a power supply wire.

Other objects, features and advantages of the invention will become apparent from the following description of the embodiments of the invention taken in conjunction with the accompanying drawings.

DESCRIPTION OF THE EMBODIMENTS

Figure 1:
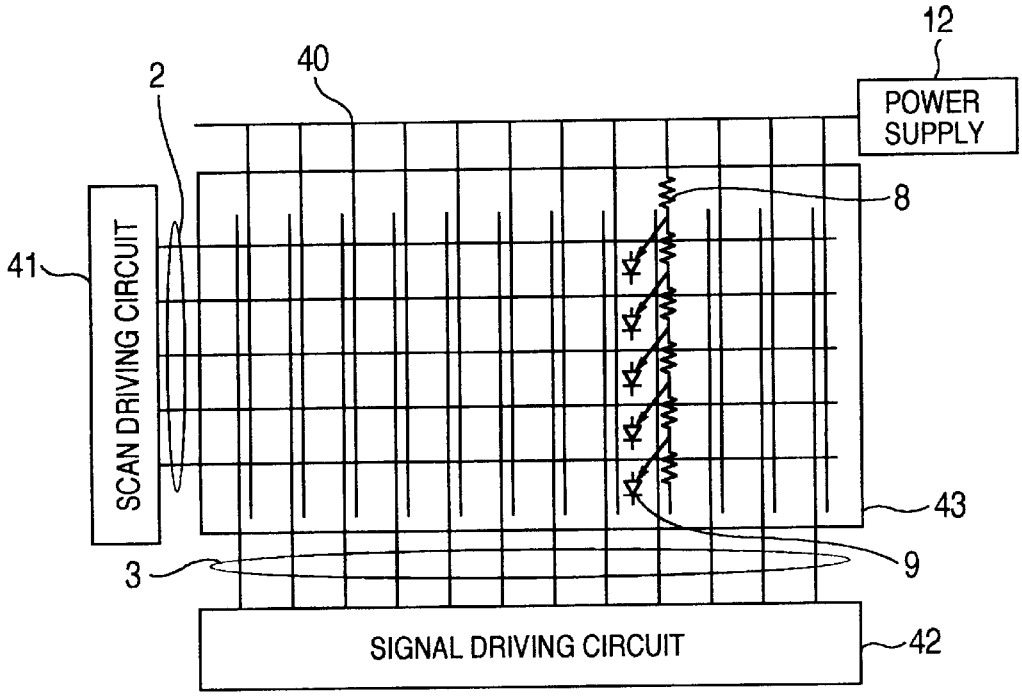
FIG. 1 is a schematic diagram for explaining the basic configuration of an image display apparatus according to the present invention.

In the following, several embodiments of the present invention will be described with reference to the accompanying drawings. FIG. 1 illustrates the general configuration of an image display apparatus according to one embodiment of the present invention. In FIG. 1, a plurality of scanning wires 2 for transmitting a scanning signal are distributively arranged in an image display region on a substrate (not shown) which forms part of a display panel. A plurality of signal wires 3 for transmitting a signal voltage are also arranged to intersect with (perpendicular to) the respective scanning wires. Each scanning wire 2 is connected to a scan driving circuit 41, so that a scanning signal is sequentially outputted from the scan driving circuit 41 to each scanning wire 2. Each signal wire 3 in turn is connected to a signal driving circuit 42, so that each signal wire 3 is applied with a signal voltage in accordance with image information from the signal driving circuit 42. Further, a plurality of power supply wires 40 are routed in parallel with the respective signal wires 3. Each power supply wire 40 has one end connected to a power supply 12. A common wire 43 is arranged around the image display region.

In a pixel region surrounded by each signal wire 3 and each scanning wire 2, an organic LED (light emitting diode) 9, for example, is disposed as a current driven electro-optical display element. In place of the organic LED 9, light emitting elements such as an inorganic LED, an electrophoresis element, FED (Field Emission Display), or the like may be used as the electro-optical display element. A thin film transistor (not shown) is connected in series with each organic LED 9 as a driving element which is applied with a bias voltage to drive the organic LED 9 for display. Also, in each pixel region, a memory control circuit (not shown) is disposed for holding a signal voltage in response to a scanning signal and controlling the driving of each thin film transistor based on the signal held therein. Each thin film transistor and organic LED 9 are supplied with direct current power from the power supply 12 through a wiring resistance 8, while the thin film transistor associated with each pixel is applied with a voltage through the wiring resistance 8. Thus, the value of the direct current voltage applied to the thin film transistor may vary depending on the position on the panel, so that the present invention employs the following configuration in the memory control circuit for applying a constant bias voltage to thin film transistors without being affected by a voltage drop by the wiring resistance 8.

Figure 2:
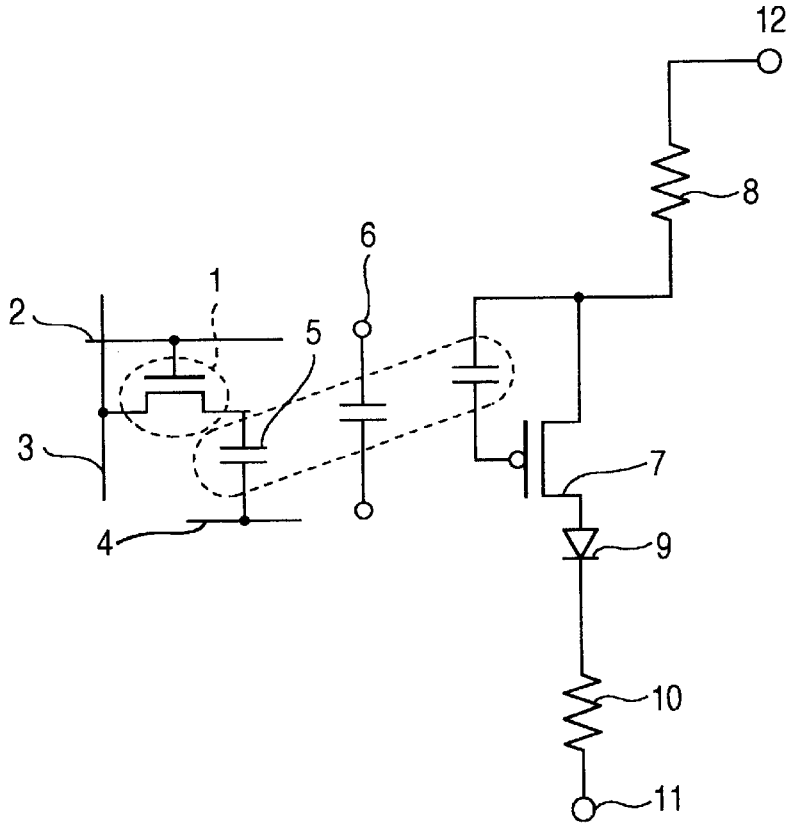
FIG. 2 is a circuit diagram for explaining the pixel driving principles.
Figure 3:
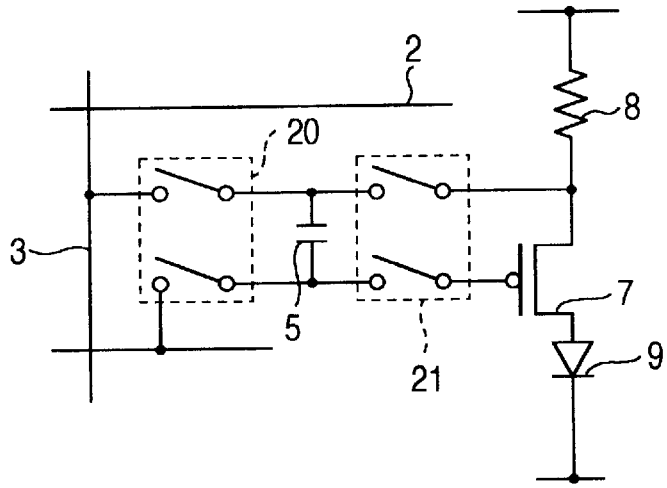
FIG. 3 is a circuit configuration diagram for explaining the operation of a pixel driving circuit.

Basically, as illustrated in FIG. 2, for driving a circuit which has the wiring resistance 8, a p-type thin film transistor (hereinafter called the "driving TFT") 7, the organic LED 9 and a common wiring resistance 10 inserted between the power supply 12 and common power supply 11, the memory control circuit comprises a sampling TFT 1 comprised of an n-type thin film transistor, and a sampling capacitor 5. In addition, as illustrated in FIG. 3, the memory control circuit comprises functions of a sampling switch 20 and a driving switch 21. Thus, the memory control circuit is configured to fetch a signal voltage from the signal wire 3, sample the fetched signal voltage, and hold the sampled signal voltage, while blocking a bias voltage applied to the driving TFT 7, and then apply the held voltage signal to the driving TFT 7 as a bias voltage.

Specifically, as illustrated in FIG. 3, as the sampling switch 20 is closed with the driving switch 21 left opened so that the sampling TFT 1 becomes conductive in response to a scanning signal on the scanning wire 2, a signal voltage from the signal wire 3 is applied to the sampling capacitor 5 through the sampling TFT 1, and charged and held on the sampling capacitor 5. Subsequently, as the sampling switch 20 is opened, i.e., as the sampling TFT 1 turns off, the signal voltage is held on the sampling capacitor 5 with the signal wire 3 and driving TFT 7 being electrically insulated in a floating state. When the driving switch 21 is closed after the floating operation is performed, the signal voltage held on the sampling capacitor 5 is applied to the driving TFT 7 as a bias voltage, so that the driving TFT 7 drives the associated organic LED 9 for display with the bias voltage applied thereto. In this event, since the signal voltage held on the sampling capacitor 5 is applied as it is between the source and gate of the driving TFT 7, a constant bias voltage can be applied between the source and gate of the TFT 7 even if a source potential of the driving TFT 7 is reduced by a voltage drop due to the wiring resistance 8.

Figure 4:
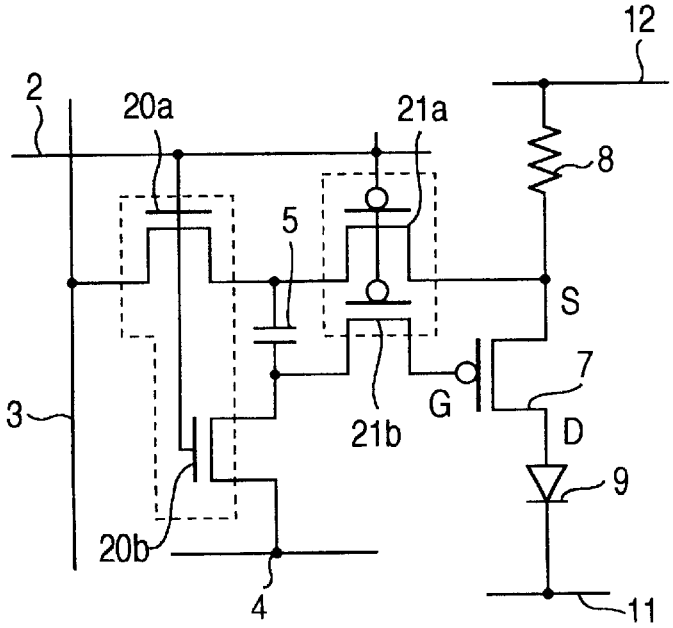
FIG. 4 is a circuit configuration diagram of a pixel illustrating a first embodiment of the present invention.

Next, the specific configuration of the memory control circuit will be described with reference to FIG. 4 when the p-type thin film transistor (driving TFT) 7 is used as a driving element. This memory control circuit comprises a main sampling switch element 20*a*, an auxiliary sampling switch element 20*b*, a sampling capacitor 5, a main driving switch element 21*a*, and an auxiliary driving switch element 21*b*. The main sampling switch element 20*a* and auxiliary sampling switch element 20*b* are each comprised of an n-type thin film transistor, while the main driving switch element 21*a* and auxiliary driving switch element 21*b* are each comprised of a p-type thin film transistor.

The main sampling switch element 20*a* has a gate connected to the scanning wire 2, a drain connected to the signal wire 3, and a source connected to the sampling capacitor 5. The auxiliary sampling switch element 20*b* has a gate connected to the scanning wire 2, a drain connected to the sampling capacitor 5, and a source connected to the common electrode (each common electrode) 4. Since the main driving switch 21*a* becomes conductive at the time the polarity of the scanning signal is inverted, the main driving switch 21*a* has a gate connected to the scanning wire 2; a drain to one end of the sampling capacitor 5; and a source to the source (one electrode for applying a bias voltage) of the driving TFT 7. The auxiliary driving switch 21*b* has a gate connected to the scanning wire 2; a drain connected to the other end of the sampling capacitor 5; and a source connected to the gate (other electrode for applying a bias voltage) of the driving TFT 7.

Next, the action of the image display apparatus using the memory control circuit illustrated in FIG. 4 will be explained with reference to FIG. 5. As a scanning signal illustrated in FIG. 5(*a*) is transmitted to the scanning wire 2, each of the sampling switch elements 20*a*, 20*b* becomes conductive (turns on) in response to the scanning signal changing from low level to high level, so that a signal voltage Vsig1 transmitted on the signal wire 3 is sampled, and the sampled signal voltage is held on the sampling capacitor 5. In this event, since the other end of the sampling capacitor 5 is connected to the common electrode 4 due to the conduction of the auxiliary sampling switch element 20*b*, the signal voltage Vsig1 is held on the sampling capacitor 5 on the basis of the common electrode 4. This signal voltage is held on the sampling capacitor 5 during a write period, and changes to a floating state in course of a transition of the scanning signal from high level to low level. Subsequently, as the polarity of the scanning signal is inverted (changes from high level to low level), each of the driving switches 21*a*, 21*b* becomes conductive (turns on), so that the signal voltage Vsig1 held on the sampling capacitor 5 is applied between the source and gate of the driving TFT 7 as a bias voltage, causing the organic LED 9 to emit light as it is driven by the driving TFT 7 for display. In this event, even if the source voltage of the driving TFT 7 becomes lower due to a voltage drop by the wiring resistance 8, the driving TFT 7 can be driven by the constant signal voltage Vsig1 continuously applied between the source and gate of the driving TFT 7 as the bias signal, without being affected by the voltage drop due to the wiring resistance 8, thereby making it possible to drive the organic LED 9 to emit light at a constant light emitting intensity and accordingly display an image of high quality.

Although the source voltage and gate voltage of the driving TFT 7 may subsequently change depending on a change in the voltage on the power supply wire, the constant signal voltage Vsig1 is applied between the source and gate of the driving TFT 7. Further, in a later cycle, a signal voltage Vsig2 is written as the next write operation when the scanning wire 2 is again applied with a scanning signal. The signal voltage Vsig2 is applied to the driving TFT 7 as a bias voltage, causing the organic LED 9 to emit light. Likewise, in this event, since the constant signal voltage Vsig2 is applied between the source and gate of the driving TFT 7 as a bias signal, it is possible to drive the organic LED 9 to emit light at a specified light emitting intensity and accordingly display an image of high quality even if a voltage drop is caused by the wiring resistance 8.

Since the memory control circuit in this embodiment uses n-type thin film transistors for the sampling switch element 20*a*, 20*b* and p-type thin film transistors for the driving switch elements 21*a*, 21*b*, each pair of transistors can be driven using a scanning signal of the same polarity, so that a single scanning wire 2 is only required for each pixel.

Figure 6:
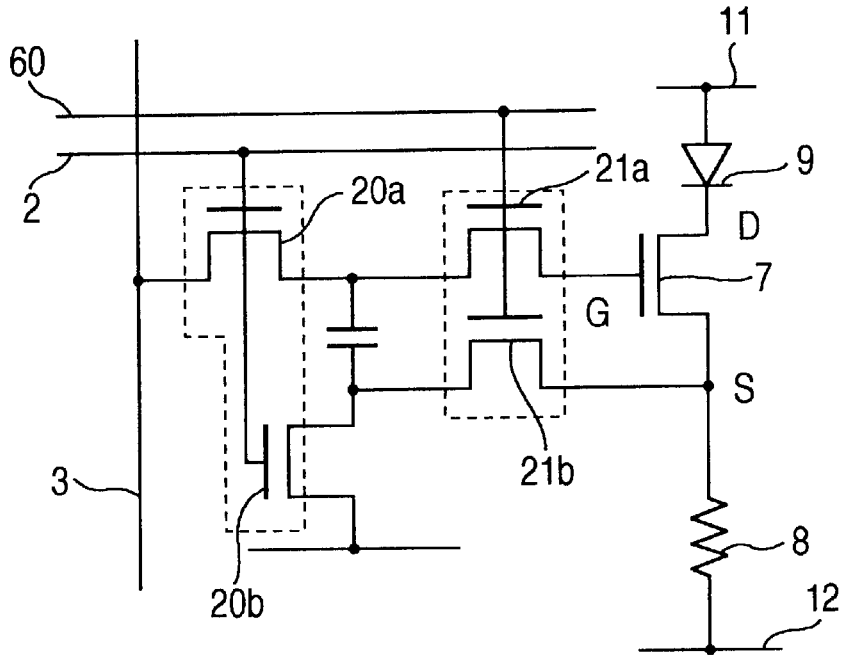
FIG. 6 is a circuit configuration diagram of a pixel illustrating a second embodiment of the present invention.

Next, a memory control circuit used in a second embodiment of the present invention will be described with reference to FIG. 6.

In the second embodiment, the use of n-type thin film transistors (driving TFT) as driving elements is taken into consideration. Also, for using n-type thin film transistors for all elements, the sampling switch elements 20*a*, 20*b* and driving switch elements 21*a*, 21*b* are comprised of n-type thin film transistors. In this configuration, an inverted scanning signal wire 60 for transmitting an inverted scanning signal which has the opposite polarity to the scanning signal, is routed in parallel with the scanning wire 2 associated with each pixel in order, and each of the driving switches 21*a*, 21*b* has a gate connected to the inverted scanning signal wire 60 to complementarily drive the respective sampling switch elements 20*a*, 20*b* and the respective driving switch elements 21*a*, 21*b*. The remaining configuration is similar to that illustrated in FIG. 4.

Figure 5:
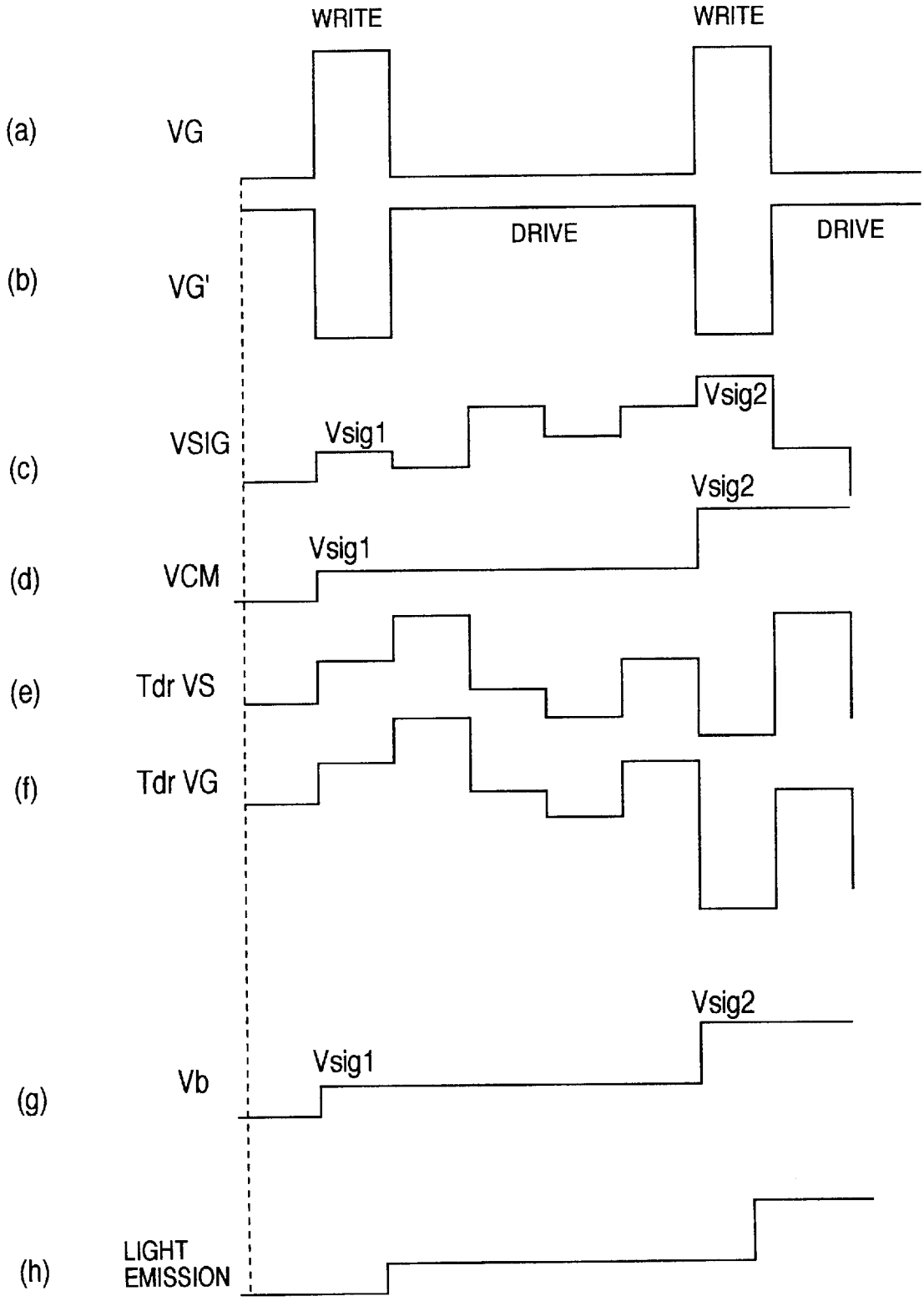
FIG. 5 is a time chart for explaining the action of the pixel illustrated in FIG. 4.

In the second embodiment, the scanning signal VG as illustrated in FIG. 5(*a*) is transmitted on the scanning wire 2; the inverted scanning signal as illustrated in FIG. 5(*b*) is transmitted on the inverted scanning signal wire 60. At the time the scanning signal VG changes from low level to high level, a signal voltage Vsig1 is sampled, and the sampled signal voltage Vsig1 is held on the sampling capacitor 5. Later, in course of a transition of the scanning signal from high level to low level, the signal voltage Vsig1 changes to a floating state. When the inverted scanning signal VG' changes from low level to high level after the signal voltage Vsing1 is driven into the floating state, the respective driving switches 21*a*, 21*b* become conductive so that the signal voltage Vsig1 is applied between the source and gate of the driving TFT 7 as a bias signal. In this event, as is the case with the first embodiment, the signal voltage Vsig1 is applied as it is between the source and gate of the driving TFT 7 as a bias voltage, even if a voltage drop is produced due to the wiring resistance 8 to cause a change in a source voltage of the driving TFT 7, thereby making it possible to drive the organic LED 9 to emit light at a luminance in accordance with the signal voltage Vsig1 and accordingly display an image of high quality, even if the voltage drop is produced due to the wiring resistance 8.

In the second embodiment, since n-type thin film transistors are entirely used, it is possible to use amorphous TFTs, which can be manufactured more easily at lower process temperatures, in the process of manufacturing the thin film transistors, thereby providing an image display apparatus which is inexpensive and suitable for mass production.

Also, in the second embodiment, the driving switch element 21*a* is inserted between the sampling capacitor 5 and the gate of the driving TFT 7, so that even if a voltage on the power supply wire appears at the gate of the driving TFT 7 as a varying voltage due to capacitive coupling of the drain and gate of the driving TFT 7, the driving switch element 21*a* can block the influence of such varying voltage.

Figure 7:
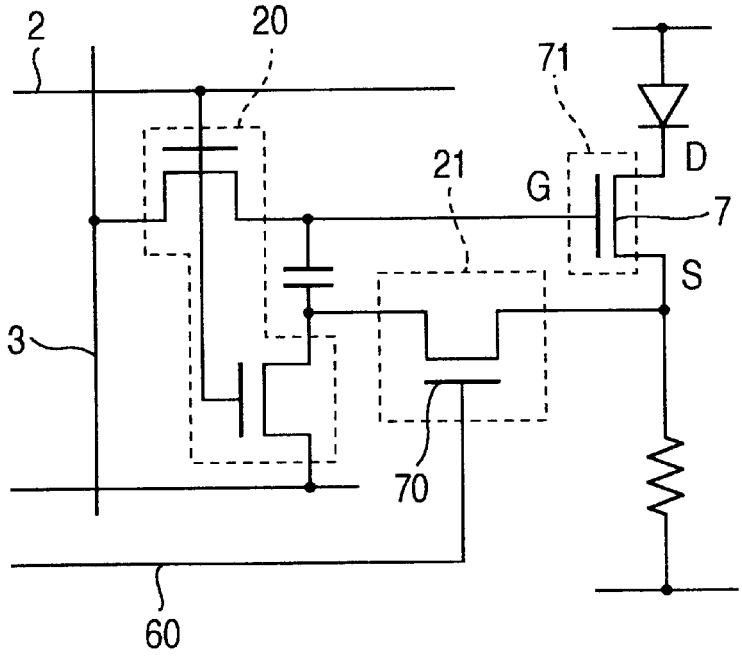
FIG. 7 is a circuit configuration diagram of a pixel illustrating a third embodiment of the present invention.

Next, a memory control circuit used in a third embodiment of the present invention will be described with reference to FIG. 7. In the third embodiment, the main driving switch 21*a* shown in FIG. 6 is removed so that the main sampling switch element 20*a* is directly connected to the gate of the driving TFT 7, and the number of thin film transistors in each pixel is reduced from five to four. The remaining configuration is similar to that illustrated in FIG. 6.

In the third embodiment, the driving TFT 7 has the gate directly connected to one end of the sampling capacitor 5, and a signal voltage during a sampling operation is held by a gate capacitance of the driving TFT 7, so that the number of required thin film transistors can be reduced by one from the aforementioned embodiments, leading to an improvement on the numerical aperture of the pixel.

Next, a fourth embodiment of the present invention will be described with reference to FIG. 8. This embodiment employs a memory circuit in place of the memory control circuit in each of the foregoing embodiments, and an n-type reference control TFT 81 inserted between the driving TFT 7 and organic LED 9 as a power supply control element. The remaining configuration is similar to that in the aforementioned respective embodiments.

The memory circuit comprises a sampling TFT 80 as a sampling switch element which becomes conductive in response to a source signal to sample a signal voltage; and a sampling capacitor 5 for holding the signal voltage sampled by the sampling TFT 80. The sampling TFT 80 is comprised of a n-type double-gate thin film transistor which has a gate connected to the scanning wire 2; a drain connected to the signal wire 3; and a source connected to the gate of the n-type driving TFT 7 and to one end of the sampling capacitor 5.

The sampling capacitor 5 has the other end connected to a source of the reference control TFT 81, and to an anode of the organic LED 9. The reference control TFT 81 has a drain connected to a source of the driving TFT 7, and a gate connected to a reference control wire 82.

In the memory circuit, the sampling TFT 80 becomes conductive in response to a scanning signal to hold a signal voltage. In the sampling period, a voltage of the common power supply 11 is changed or a potential on the common electrode 11 is held at a ground potential to bring one line of TFTs or all of TFTs into a non-driving state. After the sampling period has passed, each of the driving TFTs 7 is applied with a bias voltage. Alternatively, in the sampling period, the power supplied to each driving TFT 7 is controlled, and after the sampling period has passed, each driving TFT is supplied with the power.

Figure 9:
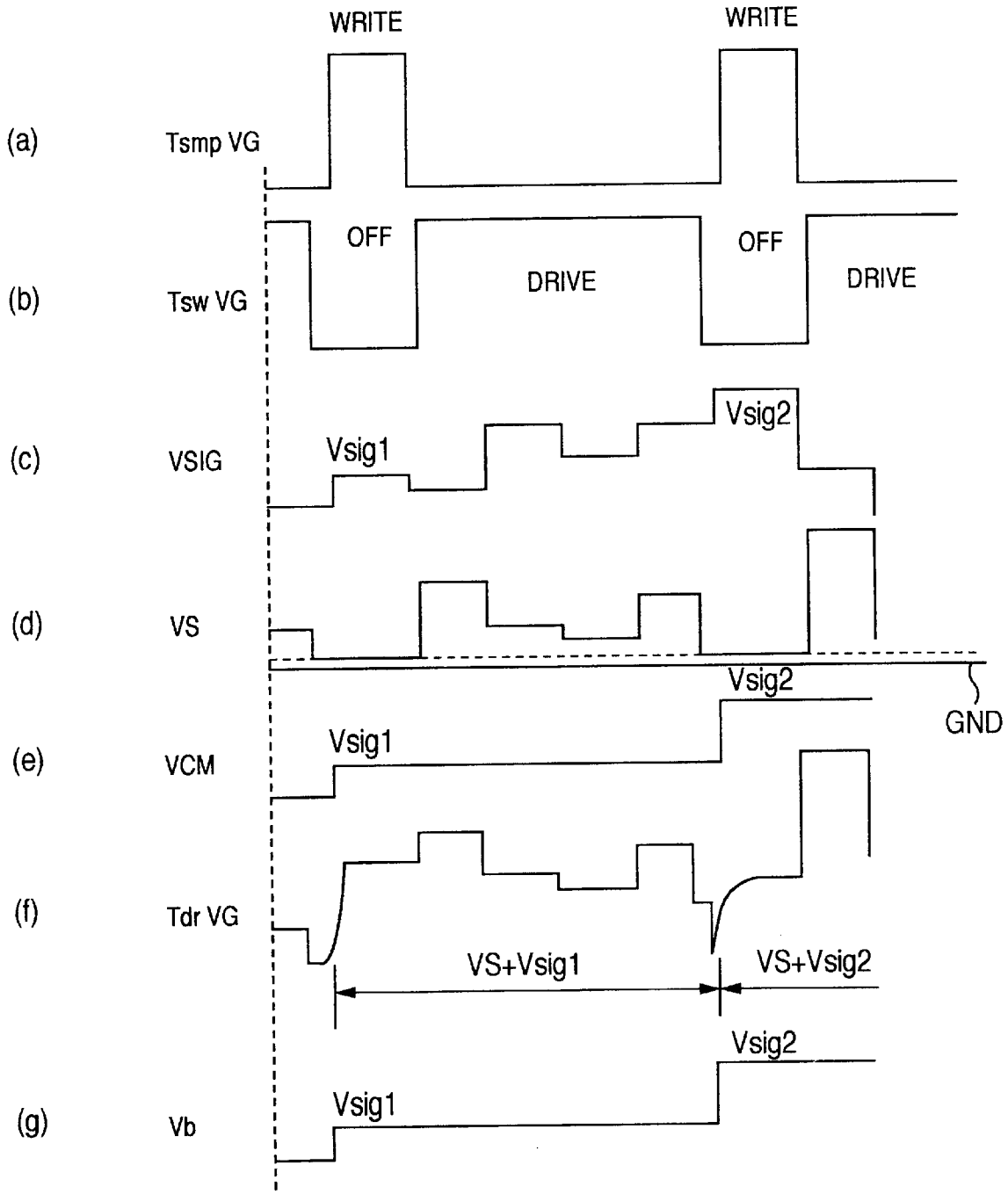
FIG. 9 is a time chart for explaining the operation of the circuit illustrated in FIG. 8.

In the following, the specific operation of the memory circuit will be explained with reference to a time chart of FIG. 9. First, when a signal voltage is written into a pixel on each scanning wire, a reference control signal TswVG supplied to the gate of the reference control TFT 81 is changed from high level to low level before a write period, as illustrated in FIGS. 9(*a*), 9(*b*), to bring the organic LEDs 9 in one line or all of pixels into a non-lighting state. Later, the sampling TFT 80 becomes conductive in response to the scanning signal changing from low level to high level, fetches a signal voltage Vsig1 from the signal wire 3, samples the signal voltage Vsig1, and holds the sampled signal voltage Vsig1 on the sampling capacitor 5. In other words, the signal voltage Vsig1 is held on the sampling capacitor 5 in the write period which is a sampling period. In this event, since the reference control TFT 81 is off, no power is supplied to the driving TFT 7, and one end of the sampling capacitor 5 is connected to the common electrode 11 through the organic LED 9. In this event, a voltage VS at one end of the sampling capacitor 5 is higher by a forward voltage of the organic LED 9 than the common electrode 11 which is at a ground potential. In other words, the one end of the sampling capacitor 5 is substantially at the ground potential, and the signal voltage Vsig1 is charged and held on the sampling capacitor 5 on the basis of the common electrode 11.

Later, when the scanning signal changes from high level to low level to terminate the write period, the signal voltage Vsig1 is held on the sampling capacitor 5, so that a voltage VCM across both ends of the sampling capacitor 5 is at the signal voltage Vsig1. Then, as the reference control signal changes from low level to high level, the reference control TFT 81 turns on, causing a source-to-drain voltage of the reference control TFT 81 to be substantially at 0 V. Consequently, the signal voltage Vsig1 held on the sampling capacitor 5 is applied between the gate and source of the driving TFT 7 as a bias voltage, causing the driving TFT 7 to conduct. As a result, the organic LED 9 becomes conductive to emit light, thereby displaying an image. In this event, a source voltage of the driving TFT 7 is substantially at the same potential as the anode of the organic LED 9, and the signal voltage Vsig1 is applied between the gate and source of the driving TFT 7 a bias voltage, so that the gate potential rises to the accompaniment of a rise in the source potential, while holding a constant bias voltage. Furthermore, even if the drain voltage of the driving TFT 7 varies, i.e. even if a voltage drop is produced due to the wiring resistance 8, a constant bias voltage can be continuously held.

In this manner, since the gate potential rises to the accompaniment of a rise in the source potential of the driving TFT 7, the sampling TFT 80 has a voltage higher than the power supply voltage of the organic LED 9 during a driving period. Also, since the signal voltage Vsig1 for controlling the organic LED 9 is held on the sampling capacitor 5 in the pixel, and applied between the source and gate of the driving TFT 7 as a bias voltage to convert the driving voltage for driving the driving TFT 7 to a voltage Vs+Vsig1 higher than the voltage Vs at the anode of the organic LED 9, the driving TFT 7 can be driven with this driving voltage.

According to the fourth embodiment, since the signal voltage Vsing1 is applied between the source and gate of the driving TFT 7 as it is as a bias voltage (actually Vs+Vsig1) even if a voltage drop is caused by the wiring resistance 8, a good image can be displayed without being affected by the voltage drop due to the wiring resistance 8 even when the image is displayed on a large-sized panel.

Also, in the fourth embodiment, since the driving circuit can be configured of three n-type thin film transistors in each pixel, the driving circuit can be simplified.

Figure 10:
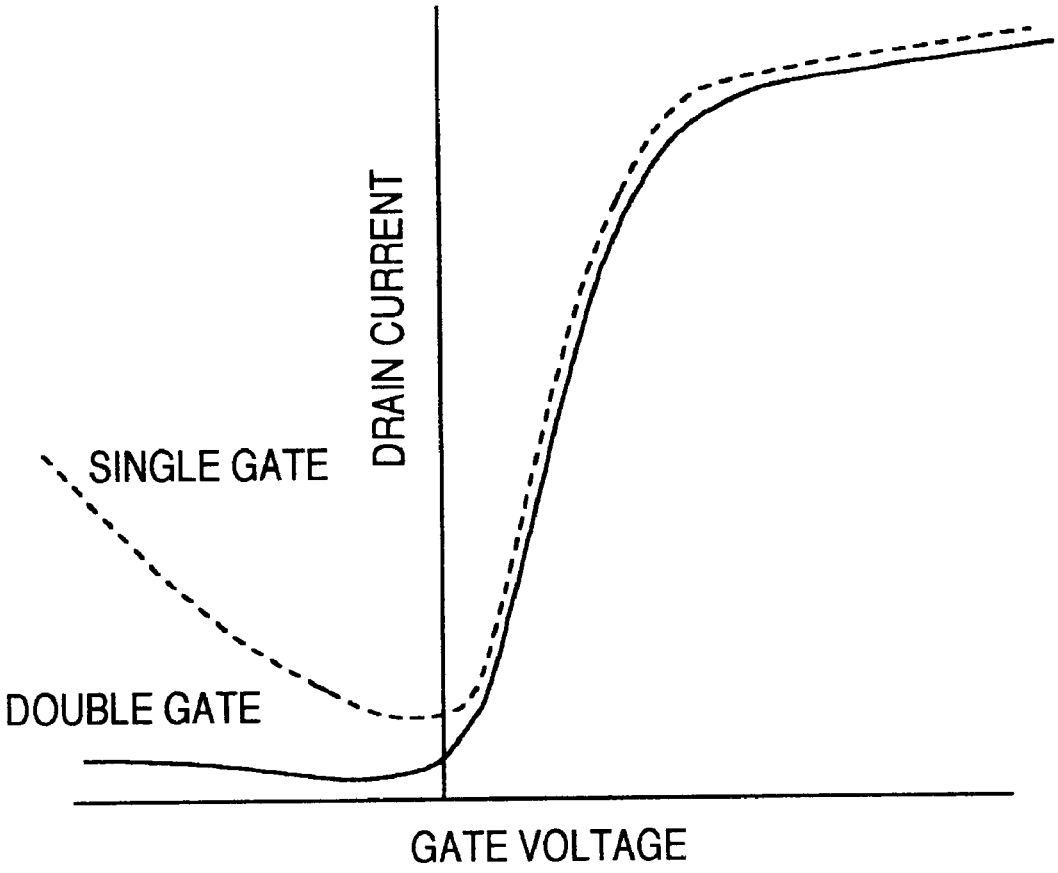
FIG. 10 is a characteristic graph for explaining the characteristics of a single gate and a double gate.

Further, in the fourth embodiment, since a double gate TFT is used as the sampling TFT 80, an off-current can be reduced, and a good display can be provided by increasing a holding ratio during a holding period. Specifically, in comparison of a single gate TFT with a double gate TFT, when used as the sampling TFT 80, the double gate TFT exhibits a less off-current in a region 0<GV, as shown in FIG. 10. It is understood from this fact that the signal voltage charged on the sampling capacitor 5 can be securely held.

Further, in the fourth embodiment, when a signal voltage is written into the sampling capacitor 5 for driving the driving TFT 7, the potential VS at one end of the sampling capacitor 5 is substantially equal to the potential at the common electrode 11. Therefore, by using the common electrode 11 shared by all pixels to maintain a constant potential over the entire surface, the signal voltage can be charged on the basis of a uniform potential within the surface (entire panel surface). Also, since the potential VS is the lowest potential in the pixel driving circuit, a driving voltage of a sampling circuit comprising TFT 80 and sampling capacitance 5 can be reduced.

Further, for controlling the reference control TFTs 81, the reference control TFTs 81 may be kept in an off state during a write period of one screen, and simultaneously turned on for all pixels after one screen has been scanned. By thus controlling the reference control TFTs 81, a moving image can be intermittently displayed on the screen to improve the quality of the displayed moving image. In addition, by dividing the screen into a plurality of regions and sequentially lighting these regions as appropriate each time one region has been scanned, the quality of a displayed moving image can be improved.

Figure 8:
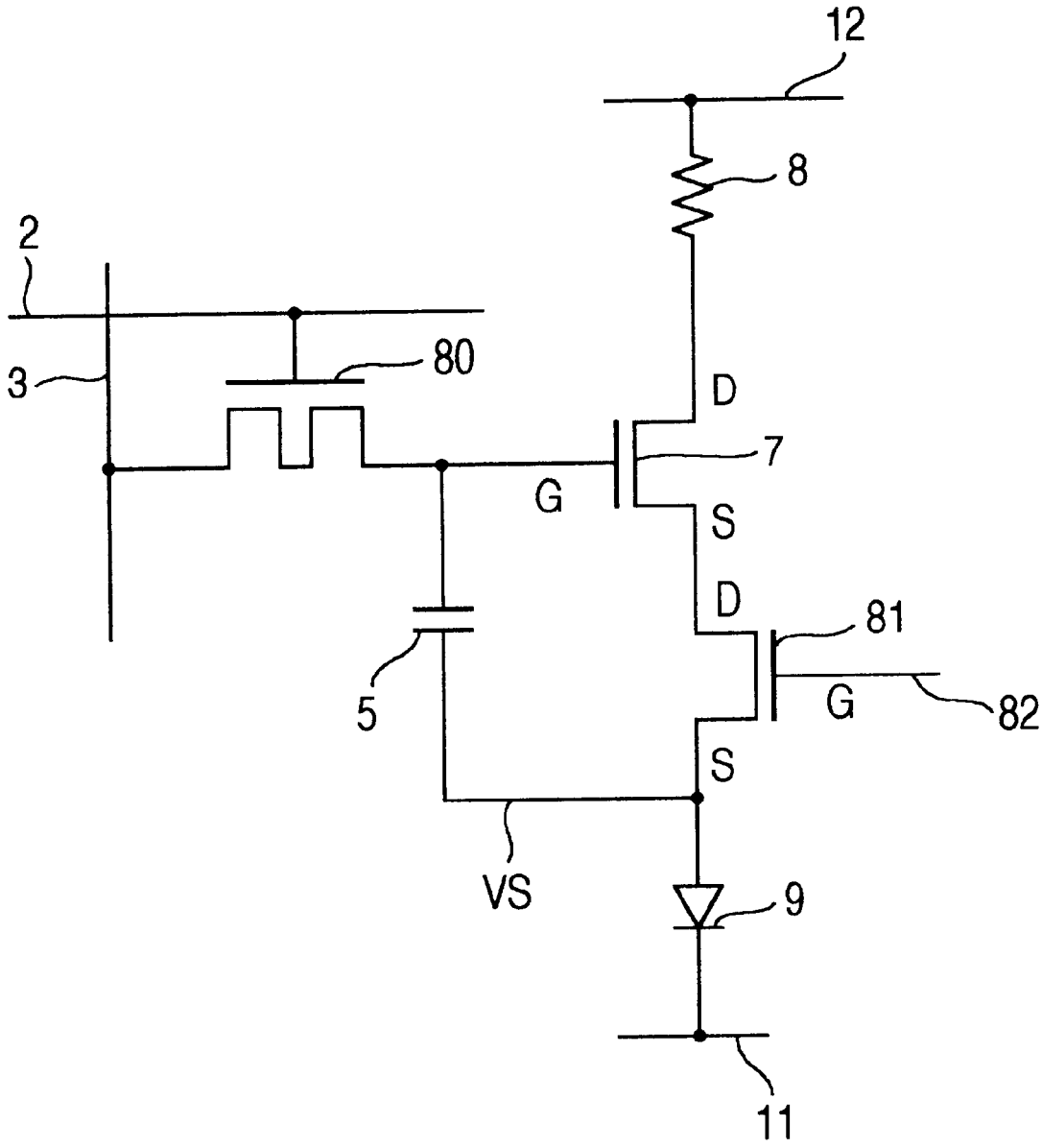
FIG. 8 is a circuit configuration diagram of a pixel illustrating a fourth embodiment of the present invention.
Figure 11:
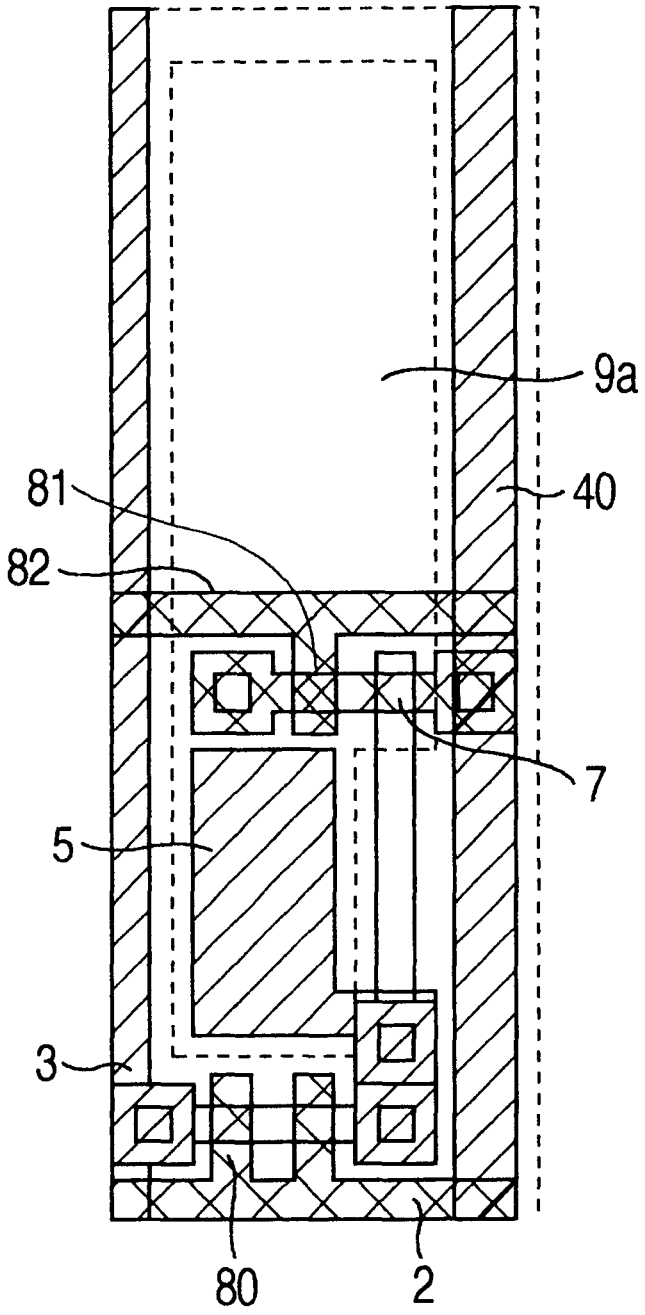
FIG. 11 is a plan view illustrating an exemplary layout of the pixel illustrated in FIG. 8.

The layout of pixels illustrated in FIG. 8 may be modified to a layout as illustrated in FIG. 11. Specifically, in FIG. 11, the scanning wire 2 and signal wire 3 are arranged perpendicularly to each other, the sampling TFT 80 using a double gate is formed near the scanning wire 2, and the sampling capacitor 5 is formed above the sampling TFT 80. The driving TFT 7, reference control TFT 81, reference control wire 82, and display electrode (electrode for coupling one end of the sampling capacitor 5 to the anode of the organic LED 9) 9*a* are disposed above the sampling capacitor 5, and the power supply wire 40 is routed in parallel with the signal wire 3. The illustrated TFTs are all n-type thin film transistors in a coplanar structure which uses a typical polysilicon TFT. The sampling capacitor 5 is formed of an interlayer capacitance between a polysilicon layer and a display electrode layer.

Figure 12:
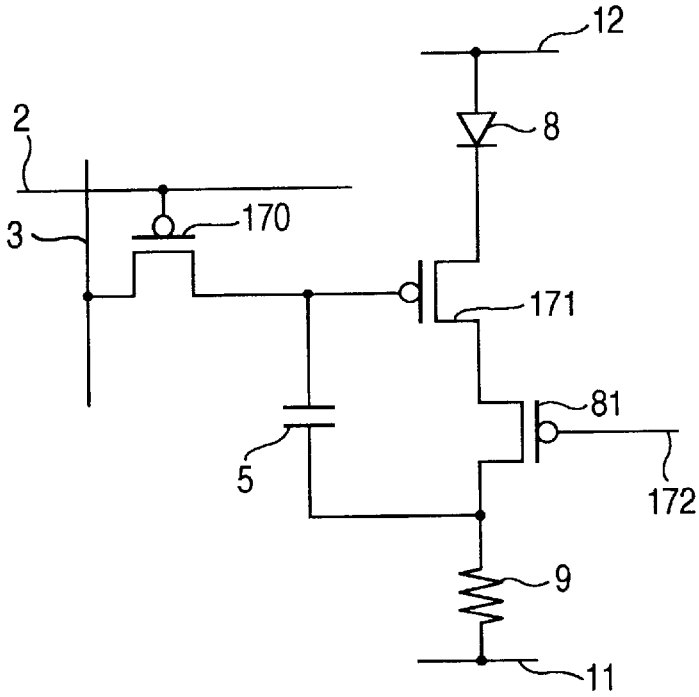
FIG. 12 is a circuit configuration diagram of a pixel illustrating a fifth embodiment of the present invention.

Further, while the fourth embodiment has been described for the memory circuit which uses n-type thin film transistors, the memory circuit may be configured of a sampling TFT 170, a driving TFT 171, and a reference control TFT 81, all of which are comprised of p-type thin film transistors, as illustrated in FIG. 12 (a fifth embodiment of the present invention). In this configuration, the reference control TFT 81 is applied at a gate with a reference control signal of the polarity opposite to the reference control signal shown in FIG. 9, and the reference control TFT 81 becomes conductive in response to a reference control signal which changes to low level out of the sampling period.

Next, a sixth embodiment of the present invention will be described with reference to FIG. 13. The sixth embodiment uses a p-type reference control TFT 160 in place of the reference control TFT 81 shown in FIG. 8, with the reference control TFT 160 having a gate connected to the scanning wire 2. The remaining configuration is similar to that illustrated in FIG. 8. In this configuration, the reference control TFT 160 becomes conductive in response to a scanning signal on the scanning wire 2 which changes to low level out of the sampling period, so that, as is the case with the foregoing embodiment, the reference control TFT 160 turns off during a write period as well as before and after the write period, thus providing similar effects to those of the foregoing embodiment.

Further, in the sixth embodiment, since the reference control TFT 160 is controlled using the scanning signal, the reference control wire 82 is eliminated, leading to a larger numerical aperture than the foregoing embodiments, resulting from a reduced number of wires, reduced areas of intersecting wires, and an improved yield rate.

Figure 14:
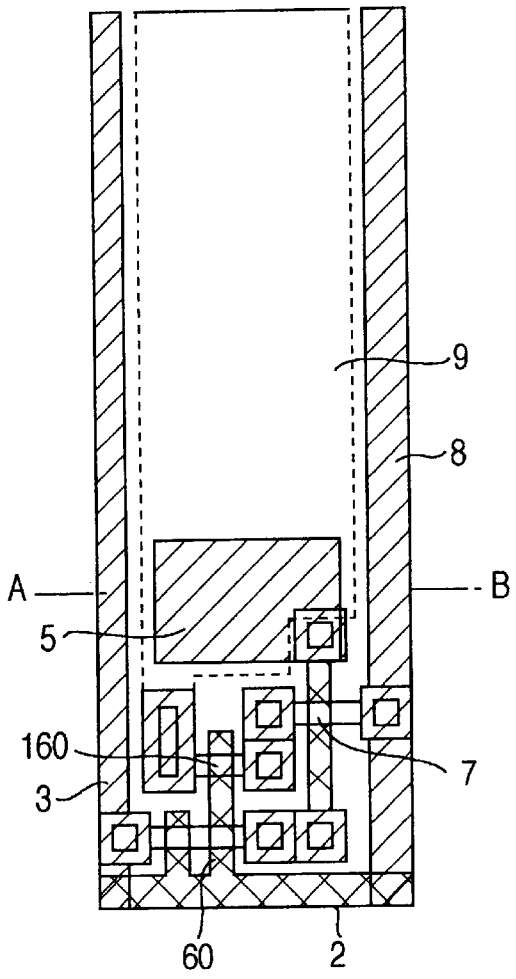
FIG. 14 is a plan view illustrating an exemplary layout of the pixel illustrated in FIG. 13.

FIG. 14 illustrates a layout of a mask in the sixth embodiment. In FIG. 14, only the reference control TFT 160 is comprised of a p-type thin film transistor, and the gate of the reference control TFT 160 is created using a single gate pattern of the double gate sampling TFT 80, thus resulting in a reduced wiring area within a pixel and an improved numerical aperture.

Figure 15:
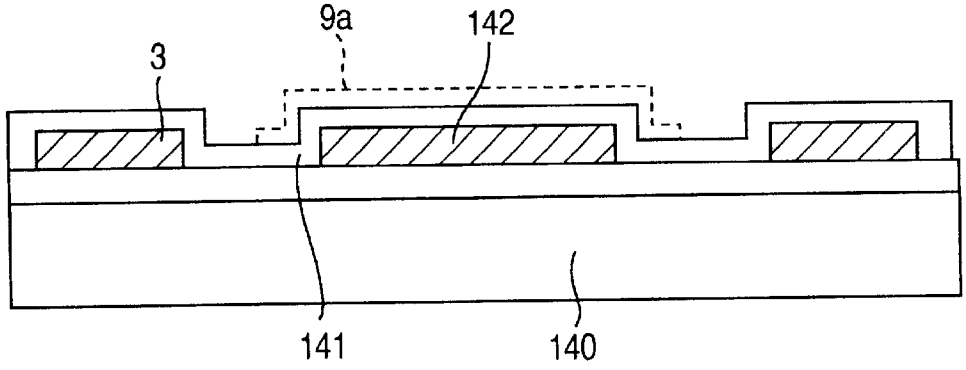
FIG. 15 is a cross-sectional view taken along a line A–B in FIG. 14.

FIG. 15 illustrates a cross-sectional view of a glass substrate 140 along a line A–B in the sixth embodiment. In the illustrated region, the sampling capacitor 5 can be formed by creating a memory capacitance electrode 142 using the same wiring layer such as a signal wire 3 or a power supply wire 40 on the glass substrate 140, and creating a display electrode 9*a* through an interlayer insulating layer 141. By utilizing capacitance structure formed by signal wiring and intra layers of display electrode, insulating thin film covering signal wiring can also be utilized as a dielectric layer, facilitating formation of a high breakdown capacitance with a simple process, and improved yield rate.

Figure 13:
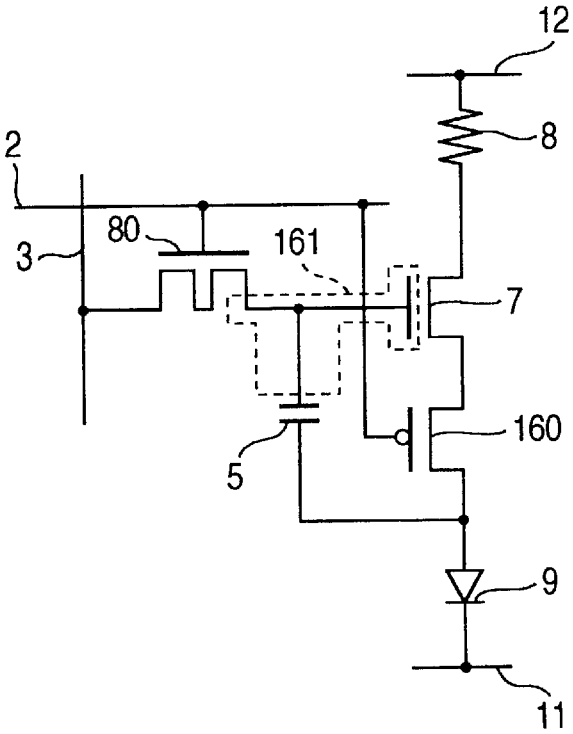
FIG. 13 is a circuit configuration diagram of a pixel illustrating a sixth embodiment of the present invention.
Figure 16:
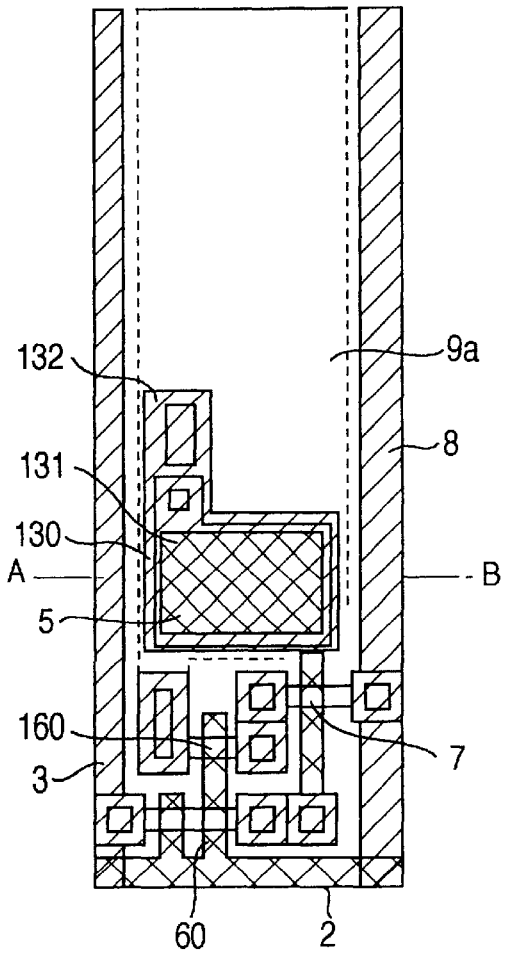
FIG. 16 is a plan view illustrating an exemplary layout of another mask pattern of the pixel illustrated in FIG. 13.
Figure 17:
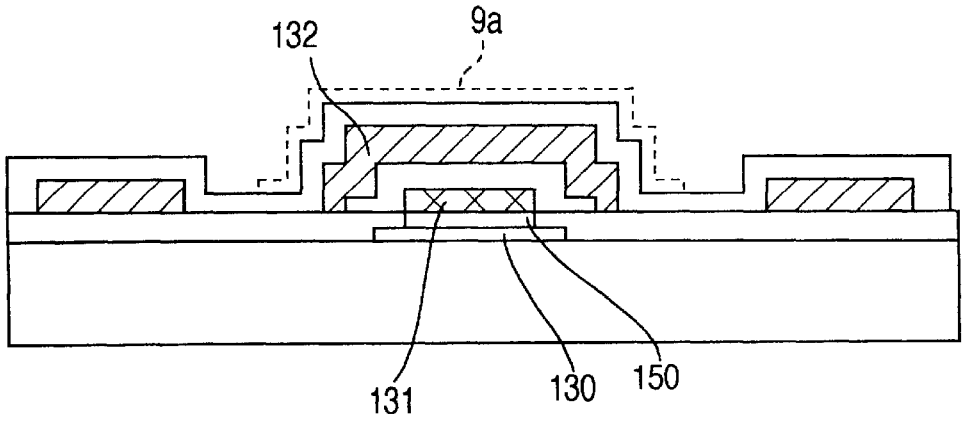
FIG. 17 is a cross-sectional view taken along a line A–B in FIG. 16.

Next, FIG. 16 illustrates the layout of another mask pattern of the pixel illustrated in FIG. 13, and FIG. 17 illustrates a cross-sectional structure of a substrate taken along a line A–B in FIG. 16. The circuit configuration of a pixel in the sixth embodiment is similar to that illustrated in FIG. 13, wherein one end of the sampling capacitor 5 connected to one end of the sampling TFT 80 is protected by a shield 161 shown in FIG. 13. Specifically, since this end is highly vulnerable to a varying potential due to capacitive coupling from the other end, it is necessary to reduce a leak current in order to suppress a leak of a signal voltage held by the sampling capacitor 5. Thus, a highly accurate signal voltage can be held by minimizing the capacitive coupling of this end from an electrostatic shield and the nearest wire.

The sampling capacitor 5 is formed of a polysilicon layer 130, a gate insulating layer 150, and a gate electrode layer 131, and covered with a wiring layer 132 and a display electrode 9*a* to prevent coupling from adjacent wires and the like. Since the sampling capacitor 5 is additionally covered with a light shielding metal layer, it is possible to reduce the influence of a photoconductive effect on the holding characteristic of an MOS capacitance and accordingly provide a good holding characteristic.

Figure 18:
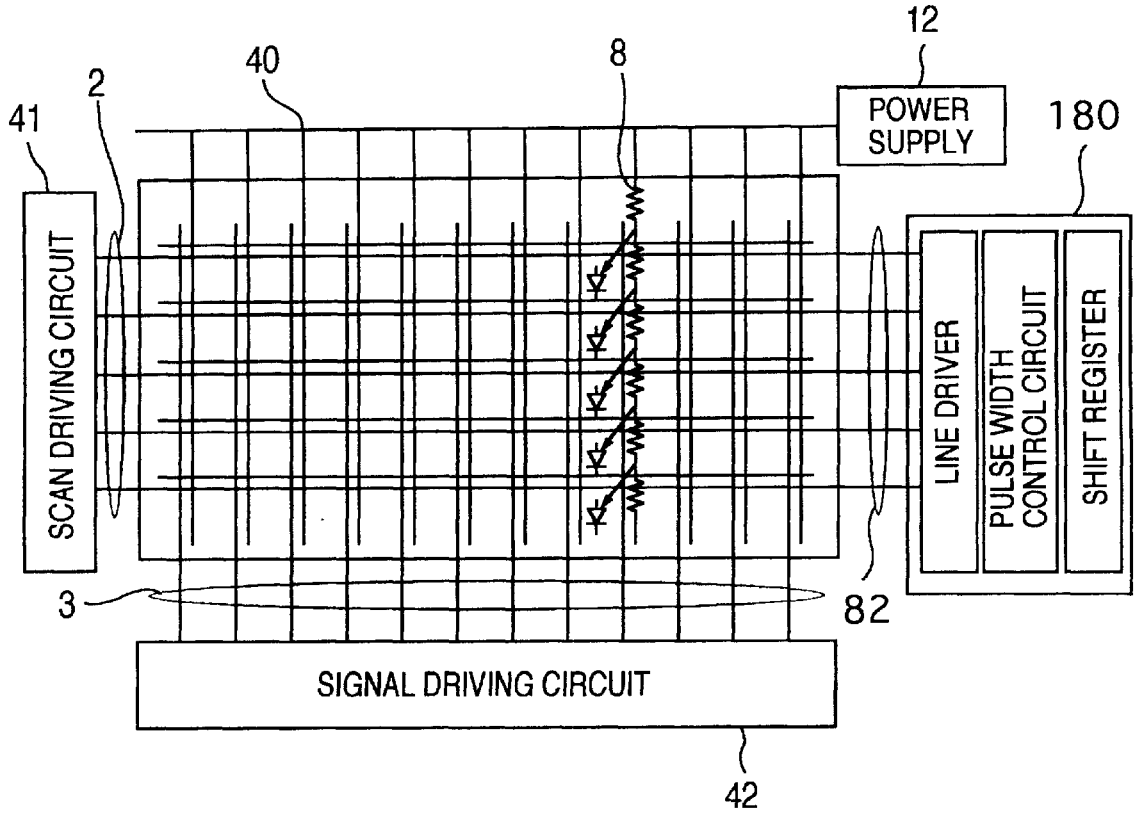
FIG. 18 is a schematic diagram illustrating the general configuration of an image display apparatus according to the present invention.

Next, FIG. 18 illustrates the general configuration of an image display apparatus which uses the pixels in the foregoing structure. How to drive pixels and signal wires in the image display apparatus illustrated in FIG. 18 has been apparent from the foregoing description. FIG. 18 specifically shows the configuration of a reference control wire driving circuit 180 for driving reference control wires 82 which are required for forming the image display apparatus. The reference control wire driving circuit 180 comprises a shift register for generating a sequentially shifting pulse; a pulse width control circuit for expanding the pulse width of the shift pulse; and a line driver for driving the reference control wires 82 connected to a matrix.

Figure 19:
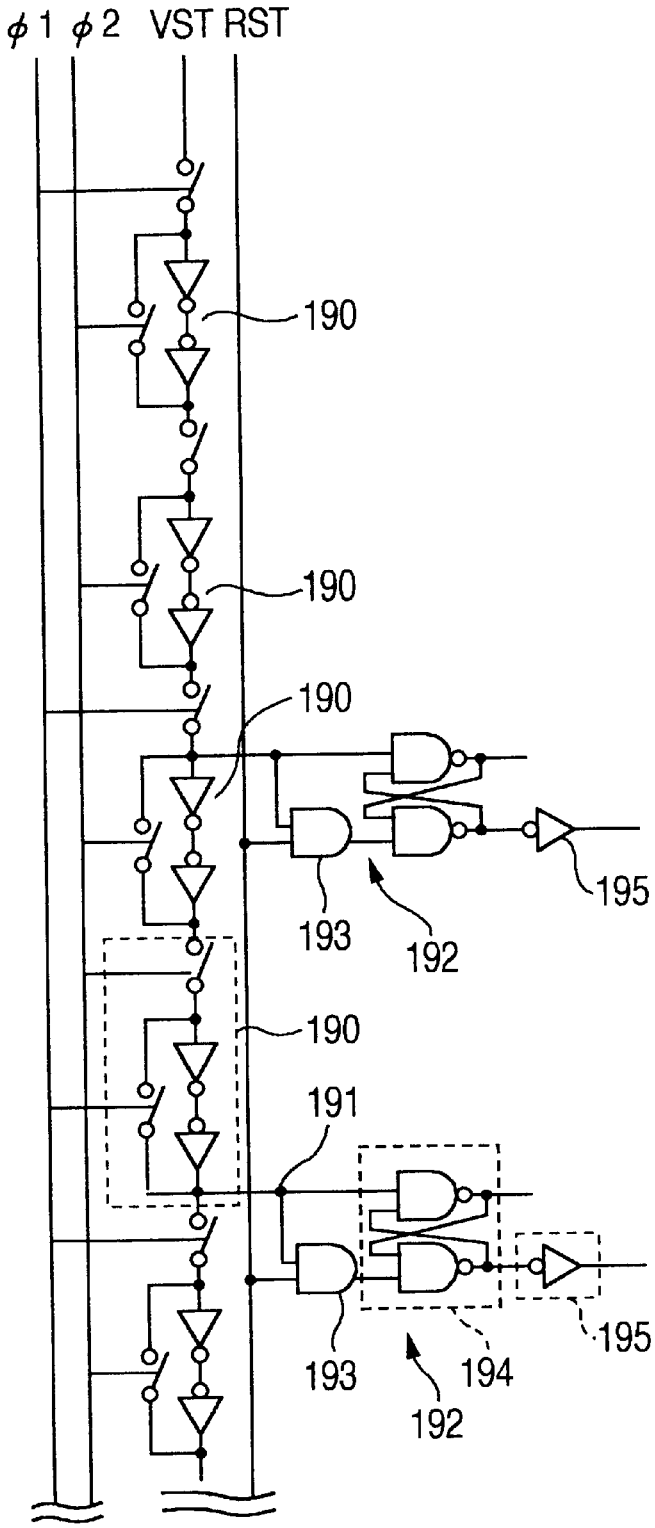
FIG. 19 is a circuit configuration diagram of a reference control wire driving circuit.

In the following, the specific configuration of the reference control wire driving circuit 180 will be described with reference to FIG. 19. The reference control wire driving circuit 180 comprises a multistage shift register 190 for generating a sequentially shifting pulse; a pulse width control circuit 192 for fetching a pulse outputted from a pulse output terminal 191 of the shift register 190 at the final stage and a pulse from an RST wire to adjust the width of the pulse from the shift register 190; and a line driver circuit comprised of a multi-stage invertor circuit 195. The pulse width control circuit 192 is comprised of an AND circuit 193, and an SR latch circuit 194. The AND circuit 193 is applied at one input terminal with a reset pulse from the RST wire which is commonly connected to all circuits. The multistage shift register 190 is driven by a two-phase clock comprised of $\phi 1$, $\phi 2$, and a scanning start signal comprised of VST to generate a sequential scanning pulse at a pulse output terminal in synchronism with the two-phase clock. In the pulse width control circuit 192, as a shift pulse is inputted from the pulse output terminal as a set signal of the SR latch circuit 194, the SR latch circuit 194 is set. As the RST signal is inputted next time, the SR latch circuit 194 is reset. The pulse output terminal 191 is also connected to one input terminal of the AND circuit 193, and the VST signal is effective only in the SR latch circuit 194 when it is set. Then, the multi-stage SR latch circuit 194, which has been set by the sequential scanning pulse, is reset by an RST signal which is applied with a delay from an arbitrary clock pulse. In this manner, the pulse control circuit 192 can generate a reference control signal TswVG which has a pulse width wider than the scanning signal.

As described above, according to each of the foregoing embodiments, pixels can be driven using all n-type or p-type thin film transistors, thereby making it possible to provide an image display apparatus which is manufactured in a simplified manufacturing process at a low cost and at a high yield rate. Also, since the driving TFT is supplied with a bias voltage using a capacitor within a pixel, a driving voltage range can be reduced in a sampling system.

As described above, according to the foregoing embodiments of the present invention, after a sampling operation for sampling a signal voltage, the signal voltage is held in a floating state, where the sampling capacitor is electrically insulated from the signal wire and driving element, and the held signal voltage is subsequently applied to the driving element as a bias voltage, so that the held signal voltage can be applied as it is to the driving element as the bias voltage without being affected by a voltage drop, if any, on a power supply wire connected to the driving element, thereby making it possible to drive the driving element for providing a display at a specified display luminance, and accordingly to display an image of high quality even when the image is displayed on a large-sized panel.

Also, according to the foregoing embodiments of the present invention, in a sampling period in which a signal voltage is held in a sampling switch element, voltage of a common power supply is changed or a potential on a common electrode shared by driving elements of the common power supply is held substantially at a ground potential to bring one line or all of driving elements into a non-driving state. After the sampling period has passed, each of the driving elements is applied with a bias voltage. Alternatively, in the sampling period in which the signal voltage is held on the sampling switch element, the power supplied to each driving element is stopped, and after the sampling period has passed, each driving element is supplied with the power. It is therefore possible to display an image of high quality on a large sized panel even if a voltage drop is caused by a power supply wire.

It should be further understood by those skilled in the art that the foregoing description has been made on embodiments of the invention and that various changes and modifications may be made in the invention without departing from the spirit of the invention and scope of the appended claims.

What is claimed is:

1. An image display apparatus comprising:

a plurality of scanning wires distributively arranged in an image display region for transmitting a scanning signal;

a plurality of signal wires arranged to intersect with said plurality of scanning wires in said image display region for transmitting a signal voltage;

a plurality of current driven electro-optical display elements each arranged in a pixel region surrounded by each said scanning wire and each said signal wire and connected to a common power supply;

a plurality of driving elements each connected in series with each said electro-optical display element, connected to said common power supply, and applied with a bias voltage to drive each said electro-optical display element for display; and a plurality of memory control circuits each for holding said signal voltage in response to said scanning signal to control driving of each said driving element based on said held signal voltage, wherein each said memory control circuit samples and holds said signal voltage while blocking a bias voltage from being applied to each said driving element, and subsequently applies each said driving element with said held signal voltage as said bias voltage.

2. An image display apparatus according to claim 1, further comprising:

a plurality of inverted scanning wires each arranged in parallel with each said scanning wire for transmitting an inverted scanning signal having a polarity opposite to that of said scanning signal, each said memory control circuit comprising:

a main sampling switch element responsive to said scanning signal to conduct for sampling said signal voltage;

a sampling capacitor for holding the signal voltage sampled by said main sampling switch element;

an auxiliary sampling switch element responsive to said scanning signal to conduct for connecting one end of said sampling capacitor to a common electrode; and a main driving switch element connected to the one end of said sampling capacitor and to one bias voltage applying electrode of said driving element, said main driving switch element responsive to said inverted scanning signal to conduct, and each said sampling capacitor having the other end connected to the other bias voltage applying electrode of each said driving element.

3. An image display apparatus according to claim 2, wherein each said driving element comprises an n-type thin film transistor, each of said main sampling switch elements and said auxiliary sampling switch elements comprises an n-type thin film transistor, and each said main driving switch element comprises an n-type thin film transistor.

4. An image display apparatus according to claim 1, wherein each said memory control circuit comprises:

a main sampling switch element responsive to said scanning signal to conduct for sampling said signal voltage;

a sampling capacitor for holding the signal voltage sampled by said main sampling switch element;

an auxiliary sampling switch element responsive to said scanning signal to conduct for connecting one end of said sampling capacitor to a common electrode;

a main driving switch element connected to the one end of said sampling capacitor and to one bias voltage applying electrode of said driving element, main driving switch element conducting when the polarity of said scanning signal is inverted; and an auxiliary driving switch element connected to the other end of said sampling capacitor and to the other bias voltage applying electrode of said driving element, said auxiliary driving switch element conducting when the polarity of said scanning signal is inverted.

5. An image display apparatus according to claim 4, wherein each said driving element comprises a p-type thin film transistor, each of said main sampling switch elements and said auxiliary sampling switch elements comprises an n-type thin film transistor, and each of said main driving switch elements and said auxiliary driving switch elements comprises a p-type thin film transistor.

6. An image display apparatus according to claim 1, further comprising:

a plurality of inverted scanning wires each arranged in parallel with each said scanning wire for transmitting an inverted scanning signal having a polarity opposite to that of said scanning signal, and each said memory control circuit comprising:

a main sampling switch element responsive to said scanning signal to conduct for sampling said signal voltage;

a sampling capacitor for holding the signal voltage sampled by said main sampling switch element;

an auxiliary sampling switch element responsive to said scanning signal to conduct for connecting one end of said sampling capacitor to a common electrode;

a main driving switch element connected to the one end of said sampling capacitor and to one bias voltage applying electrode of said driving element, said main driving switch element responsive to said inverted scanning signal to conduct; and an auxiliary driving switch element connected to the other end of said sampling capacitor and to the other bias voltage applying electrode of said driving element, said auxiliary driving switch element responsive to said inverted scanning signal to conduct.

7. An image display apparatus according to claim 6, wherein each said driving element comprises an n-type thin film transistor, each of said main sampling switch elements and said auxiliary sampling switch elements comprises an n-type thin film transistor, and each of said main driving switch elements and said auxiliary driving switch elements comprises an n-type thin film transistor.

8. An image display apparatus according to claim 1, wherein said plurality of current driven electro-optical display elements comprise organic LEDs, respectively.

9. An image display apparatus comprising:

a plurality of scanning wires distributively arranged in an image display region for transmitting a scanning signal;

a plurality of signal wires arranged to intersect with said plurality of scanning wires in said image display region for transmitting a signal voltage;

a plurality of current driven electro-optical display elements each arranged in a pixel region surrounded by each said scanning wire and each said signal wire and connected to a common power supply;

a plurality of driving elements each connected in series with each said electro-optical display element, connected to said common power supply, and applied with a bias voltage to drive each said electro-optical display element for display; and a plurality of memory control circuits each for holding said signal voltage in response to said scanning signal to control driving of each said driving element based on said held signal voltage, wherein each said memory control circuit samples and holds said signal voltage while blocking a connection with each said driving element, and subsequently releases said blocked state to apply each said driving element with said held signal voltage as said bias voltage.

10. An image display apparatus comprising:

a plurality of scanning wires distributively arranged in an image display region for transmitting a scanning signal;

a plurality of signal wires arranged to intersect with said plurality of scanning wires in said image display region for transmitting a signal voltage;

a plurality of memory circuits each arranged in a pixel region surrounded by each said scanning wire and each said signal wire for holding said signal voltage in response to said scanning signal;

a plurality of current driven electro-optical display elements each arranged in said each pixel region and connected to a common power supply; and a plurality of driving elements each connected in series with each said electro-optical display element, connected to said common power supply, and applied with a bias voltage to drive each said electro-optical display element for display;

wherein each said memory circuit includes a sampling switch element responsive to said scanning signal to conduct for sampling said signal voltage, and a sampling capacitor for holding a signal voltage sampled by said sampling switch element, each said sampling capacitor having one end connected to the common power supply through each said driving element or a power supply wire, each said sampling capacitor having the other end connected to a gate electrode of each said driving element, and in a sampling period in which said sampling switch element of each said memory circuit holds the signal voltage, each said driving element is brought into a non-driving state by changing a voltage of said common power supply or maintaining a potential on a common electrode shared by said driving elements in said common power supply at a ground potential, and each said driving element is applied with a bias voltage after said sampling period has passed.

11. An image display apparatus comprising:

a plurality of scanning wires distributively arranged in an image display region for transmitting a scanning signal;

a plurality of signal wires arranged to intersect with said plurality of scanning wires in said image display region for transmitting a signal voltage;

a plurality of memory circuits each arranged in a pixel region surrounded by each said scanning wire and each said signal wire for holding said signal voltage in response to said scanning signal;

a plurality of current driven electro-optical display elements each arranged in said each pixel region and connected to a common power supply;

a plurality of driving elements each connected in series with each said electro-optical display element, connected to said common power supply, and applied with a bias voltage to drive each said electro-optical display element for display; and a plurality of power supply control elements for controlling electric power supplied from said common power supply to each said driving element, wherein each said memory circuit includes a sampling switch element responsive to said scanning signal to conduct for sampling said signal voltage, and a sampling capacitor for holding a signal voltage sampled by said sampling switch element, each said sampling capacitor having one end connected to the common power supply through each said driving element or a power supply wire, each said sampling capacitor having the other end connected to a gate electrode of each said driving element, and in a sampling period in which said sampling switch element of each said memory circuit holds the signal voltage, each said power supply control element stops supplying the electric power to each said driving element, and supplies the electric power to each said driving element after said sampling period has passed.

12. An image display apparatus according to claim 11, wherein each of said sampling switch elements, said driving elements and said power supply control elements comprises an n-type thin film transistor, and each said power supply control element is responsive to a reference control signal to conduct when the reference control signal changes to a high level in a period out of said sampling period.

13. An image display apparatus according to claim 11, wherein each of said sampling switch elements and said driving elements comprises an n-type thin film transistor, and each said power supply control element comprises a p-type thin film transistor, and is responsive to the scanning signal to conduct when the scanning signal changes to a low level in a period out of said sampling period.

14. An image display apparatus according to claim 11, wherein each of said sampling switch elements, said driving elements and said power supply control elements comprises an n-type thin film transistor, and each said power supply control element is responsive to a reference control signal to conduct when the reference control signal changes to a low level in a period out of said sampling period.

15. An image display apparatus comprising:

a plurality of scanning wires distributively arranged in an image display region for transmitting a scanning signal;

a plurality of signal wires arranged to intersect with said plurality of scanning wires in said image display region for transmitting a signal voltage;

a plurality of current driven electro-optical display elements each arranged in a pixel region surrounded by each said scanning wire and each said signal wire and connected to a common power supply;

a plurality of driving elements each connected in series with each said electro-optical display element, connected to said common power supply, and applied with a bias voltage to drive each said electro-optical display element for display; and a plurality of memory control circuits each for holding said signal voltage in response to said scanning signal to control driving of each said driving element based on said held signal voltage, wherein each memory control circuit executes a sampling operation for sampling said signal voltage in response to said scanning signal and holding the sampled signal voltage, a floating operation, following said sampling operation, for holding said signal voltage in an electrically insulated state from each said signal wire and each said driving element, and a bias voltage applying operation, following said floating operation, for applying each said driving element with said held signal voltage as a bias voltage.

* * * * *